US007497010B2

(12) United States Patent
Gialenios et al.

(10) Patent No.: US 7,497,010 B2
(45) Date of Patent: Mar. 3, 2009

(54) METHOD FOR MANUFACTURING A COAXIAL CABLE WITH A STRIPPABLE CENTER CONDUCTOR PRECOAT

(75) Inventors: Michael Damon Gialenios, Charlotte, NC (US); Randy James Minton, Newton, NC (US); Donald Roger McDaniel, II, Vale, NC (US)

(73) Assignee: CommScope Properties LLC, Sparks, NV (US)

( * ) Notice: Subject to any disclaimer, the term of this patent is extended or adjusted under 35 U.S.C. 154(b) by 423 days.

(21) Appl. No.: 11/333,943

(22) Filed: Jan. 18, 2006

(65) Prior Publication Data

US 2006/0117559 A1 Jun. 8, 2006

Related U.S. Application Data

(62) Division of application No. 10/931,398, filed on Sep. 1, 2004, now Pat. No. 7,022,918.

(60) Provisional application No. 60/524,980, filed on Nov. 25, 2003, provisional application No. 60/503,384, filed on Sep. 16, 2003.

(51) Int. Cl.
*H01B 13/20* (2006.01)

(52) U.S. Cl. ..... 29/828; 174/105 R

(58) Field of Classification Search ..... 29/825, 29/828, 33 F; 156/51, 55, 56; 174/36, 120 R, 174/103, 107, 105 R, 106 R, 110 F; 428/375, 428/789

See application file for complete search history.

(56) References Cited

U.S. PATENT DOCUMENTS

| | | | | |
|---|---|---|---|---|
| 2,427,196 | A | 9/1947 | Cox | |
| 3,230,299 | A * | 1/1966 | Radziejowski | 174/105 R |
| 3,422,215 | A | 1/1969 | Humes | |
| 3,424,631 | A | 1/1969 | Peacock | |
| 3,485,939 | A | 12/1969 | Brown et al. | |

(Continued)

FOREIGN PATENT DOCUMENTS

WO WO 97/45843 A 12/1997

OTHER PUBLICATIONS

Engineering Committee, Society of Cable Telecommunications Engineers, American National Standard, *Test Method for Center Conductor Bond to Dielectric for Trunk, Feeder and Distribution Coaxial Cables*, ANSISCTE 12 2001.

*Primary Examiner*—Donghai D. Nguyen
(74) *Attorney, Agent, or Firm*—Alston & Bird LLP

(57) ABSTRACT

A coaxial cable is provided with a specially prepared precoat layer that facilitates removal of the precoat layer when the end of the cable is cored in preparation for receiving a connector. The cable includes an inner conductor; a foam polyolefin dielectric layer surrounding the inner conductor; an outer conductor surrounding said dielectric layer; and a precoat layer disposed between the inner conductor and the dielectric layer. The precoat layer forms a first bond interface with the inner conductor and a second bond interface with the dielectric layer, wherein the ratio of the axial shear adhesion force of the first ("A") bond to the axial shear adhesive force of the second ("B") bond is less than 1, and wherein the ratio of the axial shear adhesion force of the "A" bond formed by the precoat layer between the inner conductor to the dielectric layer to the rotational shear adhesion force of the bond is 5 or greater.

6 Claims, 4 Drawing Sheets

U.S. PATENT DOCUMENTS

| | | | | |
|---|---|---|---|---|
| 3,681,515 | A | | 8/1972 | Mildner |
| 3,794,750 | A | | 2/1974 | Garshick |
| 3,876,462 | A | | 4/1975 | Carini et al. |
| 3,891,791 | A | | 6/1975 | Schmidt |
| 4,010,315 | A | | 3/1977 | Mildner |
| 4,515,992 | A | | 5/1985 | Gupta |
| 5,926,949 | A | * | 7/1999 | Moe et al. ..... 29/828 |
| 5,959,245 | A | | 9/1999 | Moe et al. |
| 6,137,058 | A | | 10/2000 | Moe et al. |
| 6,265,667 | B1 | | 7/2001 | Stipes et al. |
| 6,596,393 | B1 | | 7/2003 | Houston et al. |
| 2003/0044606 | A1 | | 3/2003 | Iskander |

* cited by examiner

TENSILE TEST APPARATUS DIAGRAM

ROTATIONAL TEST APPARATUS DIAGRAM

METHOD FOR MANUFACTURING A COAXIAL CABLE WITH A STRIPPABLE CENTER CONDUCTOR PRECOAT

CROSS REFERENCE TO RELATED APPLICATIONS

This application is a divisional of application Ser. No. 10/931,398, filed Sep. 1, 2004, issued as U.S. Pat. No. 7,022,918, which is related to and claims priority from U.S. Provisional Patent Application Nos. 60/503,384 filed Sep. 16, 2003 and 60/524,980 filed Nov. 25, 2003.

BACKGROUND OF THE INVENTION

Coaxial cables commonly used today for transmission of RF signals, such as television signals, are typically constructed of a metallic inner conductor and a metallic sheath "coaxially" surrounding the core and serving as an outer conductor. A dielectric material surrounds the inner conductor and electrically insulates it from the surrounding metallic sheath. In some types of coaxial cables, air is used as the dielectric material, and electrically insulating spacers are provided at spaced locations throughout the length of the cable for holding the inner conductor coaxially within the surrounding sheath. In other known coaxial cable constructions, an expanded foamed plastic dielectric surrounds the inner conductor and fills the spaces between the inner conductor and the surrounding metallic sheath.

Precoat layers are an integral part of most of these coaxial cable designs. The precoat is a thin, solid or foamed polymer layer that is extruded or applied in liquid emulsions over the surface of the inner conductor of the coaxial cable prior to the application of subsequent expanded foam or solid dielectric insulation layers. Precoats are usually made up of one or more of the following materials: a polyolefin, a polyolefin copolymer adhesive, an anti-corrosion additive and fillers. The precoat layer serves one or more of the following purposes: (1) It allows for a more controlled surface to be prepared on which to deposit subsequent extruded dielectric insulation layers. (2) It is used with or without added adhesive components to promote adhesion of the dielectric material to the center conductor in order to reduce movement of the center conductor in relation to the surrounding insulation. Significant movement of this type can cause the center conductor to pull back out of the grip of a field connector creating an open electrical circuit. This phenomenon creates a field failure commonly known as a center conductor "suck out". (3) It is used with or without added adhesive components to promote adhesion of the precoat layer and subsequent dielectric insulation layers to prevent dielectric shrink back. (4) It is used to reduce or eliminate water migration paths at the dielectric/center conductor interface. Water migration into the dielectric of the coaxial cable has obvious detrimental impacts such as increases in RF attenuation.

Unfortunately, a consequence of the design of currently available precoats meeting the above criteria is that the precoat layer requires extra steps to remove it from the center conductor prior to installation of the connector. During field installation of the coaxial cable, the ends of the cable must be prepared for receiving a connector that joins the cable to another cable or to a piece of network electrical equipment, such as an amplifier. The preparation of the cable end is typically performed using a commercially available coring tool sized to the diameter of the cable. For coaxial cables having a foam dielectric, the coring tool has an auger-like bit that drills out a portion of the foam dielectric to leave the inner conductor and outer conductor exposed. After this "coring" step and just prior to the installation of the connector, it has been necessary for the installer to physically remove the precoat layer that remains adhered to the inner conductor. The prescribed method employs a tool with a nonmetallic "blade" or scraper that the technician uses to scrape or peel back the precoat layer, removing it from the conductive metal surface of the inner conductor.

According to the procedures prescribed in the field installation manual "Broadband Applications and Construction Manual", sections 9.1 and 9.2 published by coaxial cable manufacturer CommScope, Inc., the field technician is instructed to use a non-metallic tool to clean the center (inner) conductor by scoring the coating on the center conductor at the shield and scraping it toward the end of the conductor. The conductor is considered to be properly cleaned if the copper is bright and shiny. If this step is not properly performed or if this step is completed with incorrect tools, such as knives or torches, the inner conductor or other components can be damaged, reducing the electrical and/or mechanical performance of the cable and reliability of the network.

From the foregoing, it should be evident that the need exists for a coaxial cable in which the center conductor precoat layer can be more easily removed from the center conductor, preferably during the coring step, when preparing the cable for receiving a standard connector.

BRIEF SUMMARY OF THE INVENTION

The present invention provides a coaxial cable with a precoat layer that serves the important intended functions for standard precoats as described above, but also allows for easy removal of the precoat during the initial step of cable end preparation. Specially formulated precoat compositions and/or release agents along with specialized process settings are used which can facilitate the removal of the precoat layer during the initial step of end preparation using standard coring tools. The removal of the precoat during the initial end preparation (coring) step allows for more efficient connectorization and/or splicing operations in the field, elimination of the need for any special precoat removal tools, and elimination of a source of cable damage resulting from craftsmanship issues or improper end preparation by field technicians.

Precoat components can be selected from homopolymers and copolymers including, but not limited to: polyethylene homopolymers; amorphous and atactic polypropylene homopolymers; polyolefin copolymers (including but not limited to EVA, EAA, EEA, EMA, EMMA, EMAA), styrene copolymers, polyvinyl acetate (PVAc); polyvinyl alcohol (PVOH); and paraffin waxes. These components may be used singly or in any combination and proportion of two or more. The components or mixtures of the components can fall in the class of hot melts, thermoplastics or thermosets. The precoat layer, depending on chemistry, may be applied neat, from a solvent carrier, or as an emulsion. Furthermore, an anti-corrosive additive may be included.

The adhesive properties of the precoat layer may be defined in terms of an "A" bond and a "B" bond. The "A" bond is the adhesive bond at the interface of the center conductor and the precoat layer. The "B" bond is the adhesive bond at the interface of the precoat layer and the surrounding dielectric material. The chemical properties of the precoat must be such that equilibrium crystallinity and/or "A" bond strength are rapidly achieved. This is necessary to prevent aging effects of the precoat from developing a non-strippable bond prior to the use of the cable. This can be achieved through proper selection of precoat components, addition of nucleating agents and/or additives that migrate to the interface of the "A" bond to limit its upper bond strength. A foamable polymer dielectric composition is then applied over the precoat under conditions that produce a bond ("B" bond) between the precoat and the dielectric.

In achieving the objectives of the present invention, it is important that the precoat composition has sufficient thickness and continuity so as to block axial migration of moisture along the inner conductor. Preferably, the precoat composition is applied to the inner conductor to yield a final thickness of from 0.0001 inch to 0.020 inch.

It is also important that the bond strength of the "A" bond interface and the "B" bond interface be controlled in such a way that the precoat layer will be removed completely and cleanly from the inner conductor as a result of the shear forces applied to the precoat layer when a standard commercially available coaxial cable coring tool is used to prepare the cable end for receiving a connector. More particularly, it is important that the axial shear adhesion strength of the bond interface between the inner conductor and the precoat layer, (i.e. the "A" bond) and the axial shear adhesive strength of the interface between the precoat layer and the dielectric, (i.e. the "B" bond), have a ratio less than 1. This will assure that when the precoat is removed from the inner conductor, the bond failure will occur at the precoat-inner conductor interface, i.e. the "A" bond, such that no residual precoat is left on the inner conductor.

Additionally, it is important that the bond formed by the precoat layer between the inner conductor and the dielectric should have a much lower bond strength in a direction tangential to the surface of the inner conductor than in the axial direction of the conductor. This will assure that the precoat "A" bond has sufficient adhesion strength in the axial direction to perform its intended function (reduction of movement of the inner conductor in relation to the surrounding dielectric and elimination of water migration along the center conductor), while it will still be readily removable from the inner conductor by the tangential peeling forces that are exerted upon it during coring. In this regard, it is preferred that the ratio of the axial shear adhesion strength of the bond between the inner conductor and the precoat layer to the rotational shear adhesion strength of the bond is 5 or greater, and more desirably 7 or greater.

These objectives are achieved by appropriate selection of the precoat composition and process conditions as described herein. In one embodiment, the precoat composition comprises a single polymer component, while in another embodiment two or more components are compounded or blended into a precoat composition. The precoat composition can include adhesives, fillers, anti-corrosion additives, reactants, release agents, crosslinkers, with or without carriers, solvents or emulsifiers. The precoat composition is then applied to the inner conductor in a manner that produces a film that adheres to the center conductor with a final thickness of from 0.0001 inch to 0.020 inch. An insulation compound is then applied over the precoat resulting in a bond being produced ("B" bond) between the precoat and the dielectric.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

FIG. 1 is a perspective view of a coaxial cable according to one embodiment of the invention.

FIGS. 2A and 2B schematically illustrate a method of making a coaxial cable corresponding to the embodiment of the invention illustrated in FIG. 1.

DETAILED DESCRIPTION OF THE INVENTION

The present invention now will be described more fully hereinafter with reference to the accompanying drawings, in which some, but not all embodiments of the invention are shown. Indeed, the invention may be embodied in many different forms and should not be construed as limited to the embodiments set forth herein; rather, these embodiments are provided so that this disclosure will satisfy applicable legal requirements. Like numbers refer to like elements throughout.

Figure 1:
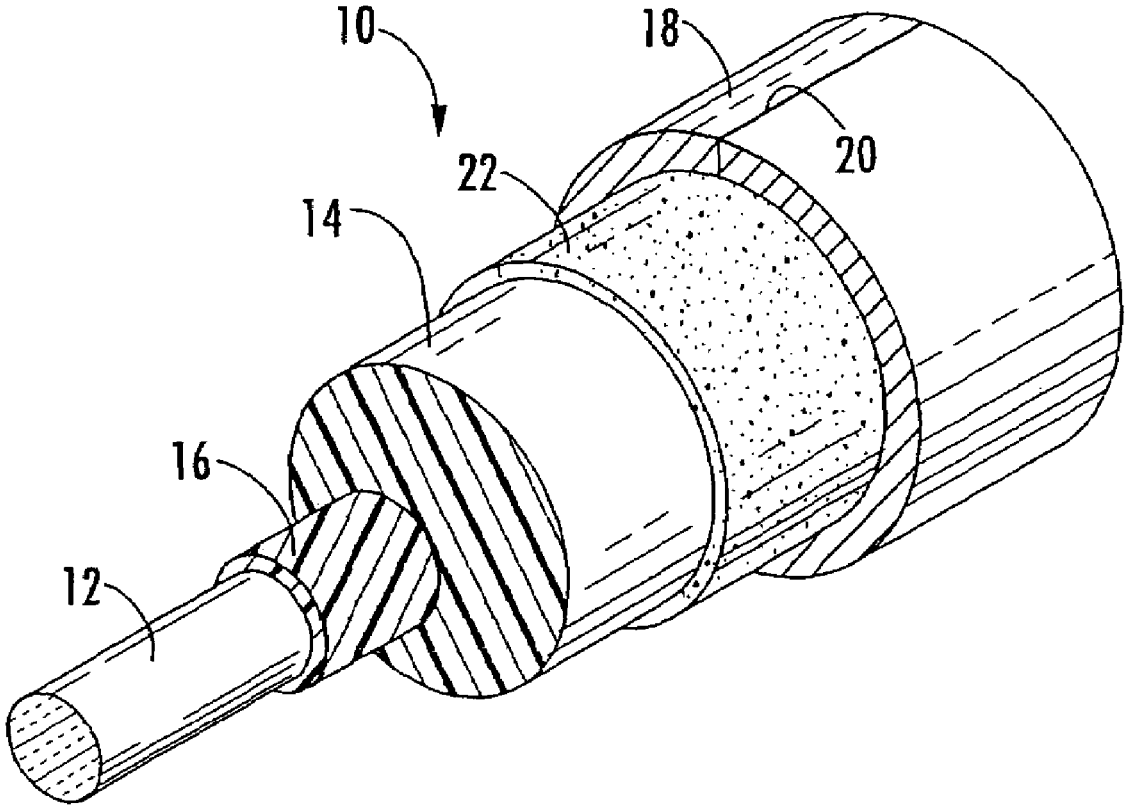

In accordance with a preferred embodiment of the invention, FIG. 1 illustrates a coaxial cable 10 of the type typically used as trunk and distribution cable for the long distance transmission of RF signals such as cable television signals, cellular telephone signals, internet, data and the like. Typically, the cable 10 illustrated in FIG. 1 has a diameter of from about 0.3 and about 2.0 inches when used as trunk and distribution cable.

As illustrated in FIG. 1, the coaxial cable 10 comprises an inner conductor 12 of a suitable electrically conductive material and a surrounding dielectric layer 14. The inner conductor 12 is preferably formed of copper, copper-clad aluminum, copper-clad steel, or aluminum. In addition, as illustrated in FIG. 1, the conductor 12 is typically a solid conductor. In the embodiment illustrated in FIG. 1, only a single inner conductor 12 is shown, located coaxially in the center of the cable, as this is the most common arrangement for coaxial cables of the type used for transmitting RF signals.

A dielectric layer 14 surrounds the center conductor 12. The dielectric layer 14 is a low loss dielectric formed of a suitable plastic such as polyethylene, polypropylene or polystyrene. Preferably, to reduce the mass of the dielectric per unit length and thus the dielectric constant, the dielectric material is an expanded cellular foam composition, and in particular, a closed cell foam composition is preferred because of its resistance to moisture transmission. The dielectric layer 14 is preferably a continuous cylindrical wall of expanded foam plastic dielectric material and is more preferably a foamed polyethylene, e.g., high-density polyethylene. Although the dielectric layer 14 of the invention generally consists of a foam material having a generally uniform density, the dielectric layer 14 may have a gradient or graduated density such that the density of the dielectric increases radially from the center conductor 12 to the outside surface of the dielectric layer, either in a continuous or a step-wise fashion. For example, a foam-solid laminate dielectric can be used wherein the dielectric 14 comprises a low-density foam dielectric layer surrounded by a solid dielectric layer. These constructions can be used to enhance the compressive strength and bending properties of the cable and permit reduced densities as low as 0.10 g/cc along the center conductor 12. The lower density of the foam dielectric 14 along the center conductor 12 enhances the velocity of RF signal propagation and reduces signal attenuation.

A thin polymeric precoat layer 16 surrounds the center conductor 12 and adheres the center conductor to the surrounding dielectric 14. The precoat layer 16 preferably has a thickness of from 0.0001 to 0.020 inches, more desirably from 0.0005 to 0.010 inches, and most desirably from 0.005 to 0.010 inches.

Closely surrounding the dielectric layer 14 is an outer conductor 18. In the embodiment illustrated in FIG. 1, the outer conductor 18 is a tubular metallic sheath. The outer conductor 18 is formed of a suitable electrically conductive metal, such as aluminum, an aluminum alloy, copper, or a copper alloy. In the case of trunk and distribution cable, the outer conductor 18 is both mechanically and electrically continuous to allow the outer conductor 18 to mechanically and electrically seal the cable from outside influences as well as to prevent the leakage of RF radiation. However, the outer conductor 18 or can be perforated to allow controlled leakage of RF energy for certain specialized radiating cable applications. In the embodiment illustrated in FIG. 1, the outer conductor 18 is made from a metallic strip that is formed into a tubular configuration with the opposing side edges butted together, and with the butted edges continuously joined by a continuous longitudinal weld, indicated at 20. While production of the outer conductor 18 by longitudinal welding has been illustrated for this embodiment, persons skilled in the art will recognize that other known methods could be employed such as extruding a seamless tubular metallic sheath.

The inner surface of the outer conductor 18 is preferably continuously bonded throughout its length and throughout its circumferential extent to the outer surface of the dielectric layer 14 by a thin layer of adhesive 22. An optional protective jacket (not shown) may surround the outer conductor 18. Suitable compositions for the outer protective jacket include thermoplastic coating materials such as polyethylene, polyvinyl chloride, polyurethane and rubbers.

Figure 2A:
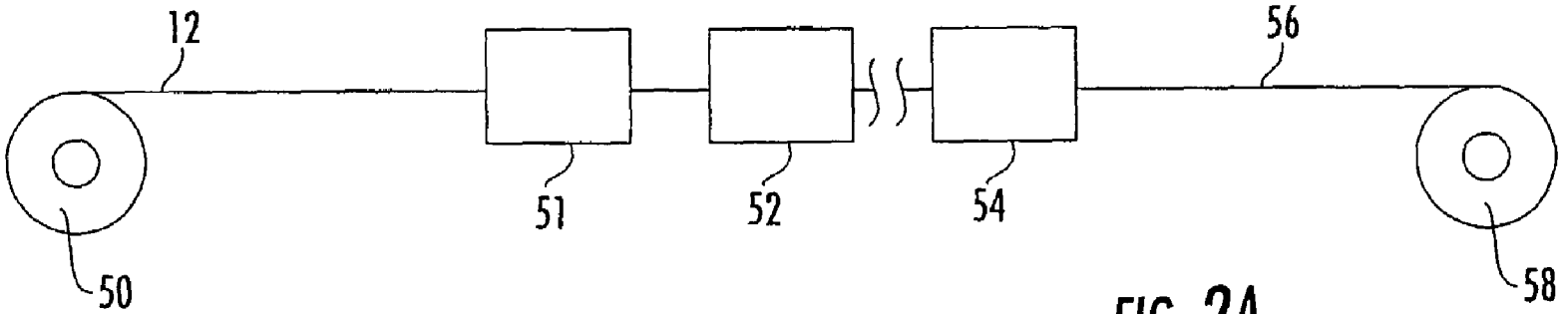
Figure 2B:
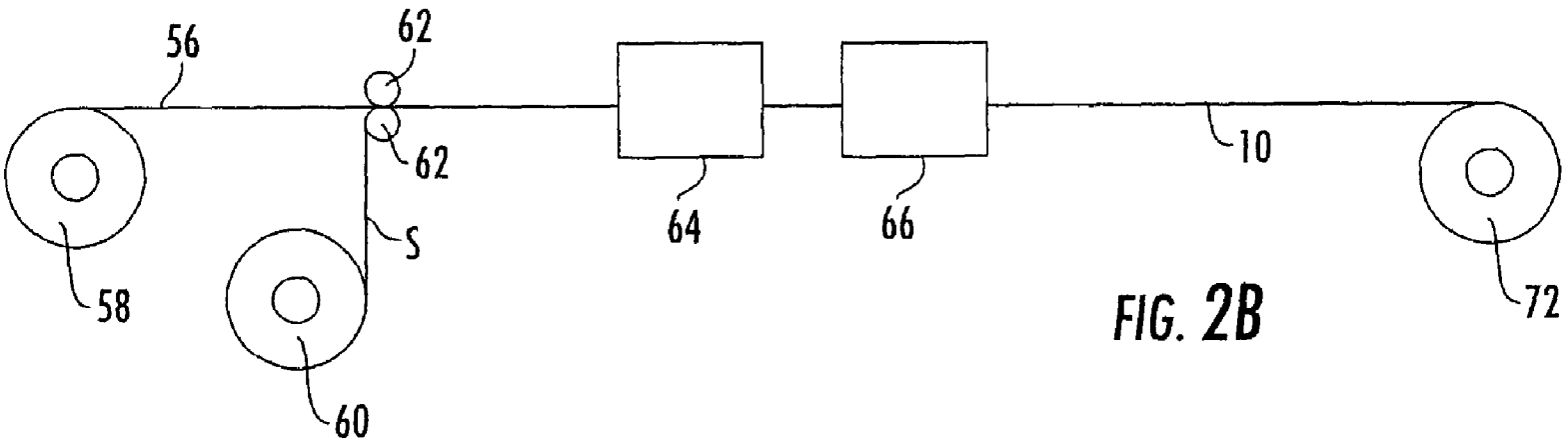

FIGS. 2A and 2B illustrate one method of making the cable 10 of the invention illustrated in FIG. 1. As illustrated in FIG. 2A, the center conductor 12 is directed from a suitable supply source, such as a reel 50, along a predetermined path of travel (from left to right in FIG. 2A). The center conductor 12 is preferably advanced first through a preheater 51, which heats the conductor to an elevated temperature to remove moisture or other contaminants on the surface of the conductor and to prepare the conductor for receiving the precoat layer 16. The preheated conductor then passes through a cross-head extruder 52, where the polymer precoat composition is extruded onto the surface of conductor 12. The precoat composition is a thermoplastic homopolymer or copolymer composition selected from the group consisting of polyethylene homopolymer, amorphous and atactic polypropylene homopolymer, polyolefin copolymers (including but not limited to EVA, EAA, EEA, EMA, EMMA, EMAA), styrene copolymers, polyvinyl acetate, polyvinyl alcohol, paraffin waxes, and blends of two or more of the foregoing. In one exemplary composition, the precoat composition contains at least 50% by weight of a polyethylene, and may additionally include one or more copolymers of ethylene with a carboxylic acid, for example an acrylic or methacrylic acid. When the polyethylene is blended with one or more such copolymers, the copolymer content is preferably less than 25% by weight. For example, the precoat composition may contain a blend of at least 50% by weight low density polyethylene, more desirably 75% or greater, with an ethylene acrylic acid copolymer. The precoat composition may also include one or more of fillers, anti-corrosion additives, reactants, release agents and crosslinking agents. The polyethylene polymer component used in the precoat composition preferably has a melt index (MI) of at least 35 g/10 min. and desirably at least 50 g/10 min. As is well known, the melt index is defined as the amount of a thermoplastic resin, in grams, which can be forced through an extrusion rheometer orifice of 0.0825 inch diameter in ten minutes under a force of 2.16 kilogram at 190° C. The high melt index results in the precoat layer having a relatively low tear strength, which facilitates the peeling or tearing of the precoat material away from the center conductor during coring. The bond is more frictive or frictional in nature than adhesive, which provides the needed axial bond strength while facilitating peeling away from the center conductor. This characteristic is also enhanced by the relatively low adhesive copolymer content (e.g. the EAA or EMA copolymer), or absence of such copolymer in the precoat composition. This also allows for preferential bonding of the precoat layer to the surrounding dielectric (B bond) material rather than the metallic surface of the center conductor (A bond) while maintaining the water blocking characteristics of the precoat layer. Some further illustrative examples of precoat compositions include the following: a 50 MI low density polyethylene resin (LDPE); an 80/20 parts by weight blend of 80 MI LDPE and EMMA copolymer adhesive; 80/20 parts by weight blend of 80 MI LDPE and EAA copolymer adhesive; a blend of one of the foregoing with up to 5% by weight of a microcrystalline wax.

The precoat layer is allowed to cool and solidify prior to being directed through a second extruder apparatus 54 that continuously applies a foamable polymer composition concentrically around the coated center conductor. Preferably, high-density polyethylene and low-density polyethylene are combined with nucleating agents in the extruder apparatus 54 to form the polymer melt. Upon leaving the extruder 54, the foamable polymer composition foams and expands to form a dielectric layer 14 around the center conductor 12.

In addition to the foamable polymer composition, an adhesive composition is preferably coextruded with the foamable polymer composition around the foam dielectric layer 14 to form adhesive layer 22. Extruder apparatus 54 continuously extrudes the adhesive composition concentrically around the polymer melt to form an adhesive coated core 56. Although coextrusion of the adhesive composition with the foamable polymer composition is preferred, other suitable methods such as spraying, immersion, or extrusion in a separate apparatus can also be used to apply the adhesive layer 22 to the dielectric layer 14 to form the adhesive coated core 56. Alternatively, the adhesive layer 22 can be provided on the inner surface of the outer conductor 18.

After leaving the extruder apparatus 54, the adhesive coated core 56 is preferably cooled and then collected on a suitable container, such as reel 58, prior to being advanced to the manufacturing process illustrated in FIG. 2B. Alternatively, the adhesive coated core 56 can be continuously advanced to the manufacturing process of FIG. 2B without being collected on a reel 58.

As illustrated in FIG. 2B, the adhesive coated core 56 can be drawn from reel 58 and further processed to form the coaxial cable 10. A narrow elongate strip S, preferably formed of aluminum, from a suitable supply source such as reel 60, is directed around the advancing core 56 and bent into a generally cylindrical form by guide rolls 62 so as to loosely encircle the core to form a tubular sheath 18. Opposing longitudinal edges of the strip S can then be moved into abutting relation and the strip advanced through a welding apparatus 64 that forms a longitudinal weld 20 by joining the abutting edges of the strip S to form an electrically and mechanically continuous sheath 18 loosely surrounding the core 56. Once the sheath 18 is longitudinally welded, the sheath can be formed into an oval configuration and weld flash scarfed from the sheath as set forth in U.S. Pat. No. 5,959,245. Alternatively, or after the scarfing process, the core 56 and surrounding sheath 18 advance directly through at least one sinking die 66 that sinks the sheath onto the core 56, thereby causing compression of the dielectric 14. A lubricant is preferably applied to the surface of the sheath 18 as it advances through the sinking die 66. An optional outer polymer jacket can then be extruded over the sheath 18. The thus produced cable 10 can then be collected on a suitable container, such as a reel 72 for storage and shipment.

In achieving the controlled bond strengths that provide the strippable properties to the precoat, it is preferable to preheat the inner conductor in preheater 51 to a surface temperature of 75° F. to 300° F. prior to application of the precoat so as to promote adhesion between the precoat layer and the surface of the center conductor 12. Preheat temperatures below this range may not sufficiently heat the center conductor, thus leaving moisture, oil or other contaminants on its surface. Such contamination can impede consistent adhesion at the conductor-precoat layer interface (A bond) and allow moisture migration along the surface of the inner conductor. Likewise, preheat temperatures above this range may also deter adhesion by degrading the precoat polymer in contact with the surface of the center conductor causing the precoat layer to bubble or otherwise lose its consistency.

Between precoat and dielectric applications, it is also important to control reheating of the center conductor and precoat layer prior to application of the dielectric. If the coated conductor is reheated at all, reheating temperatures of less than 200° F. should be applied to promote a suitable B bond between these layers. Heating the precoat and conductor above this temperature prior to application of the dielectric layer may inhibit the adhesion of the two layers. Overheating at this stage of the process can degrade the dielectric layer in contact with the precoat by exposing the dielectric polymer to temperatures above its processing range. Such resulting degradation and/or voids in the dielectric layer can reduce the B bond strength and create paths for moisture migration between the precoat and dielectric layers.

The controlled bond adhesion properties between the A bond interface and the B bond interface are such that the precoat layer is removed completely and cleanly from the inner conductor as a result of the shear forces applied to the precoat layer during preparation of the cable end for receiving a connector using a standard commercially available coaxial cable coring tool. Examples of commercially available coaxial cable coring tools include the Cableprep SCT Series coring tools from CablePrep Inc. of Chester Conn., the Cablematic CST series coring tools from Ripley Company, Cromwell Conn., and the Corstrip series of coring tools from Lemco Tool Corporation of Cogan Station, Pa.

These coring tools include cutting edges that exert a combination of rotational shear and axial shear on the cable core as the tool is rotated relative to the cable. The coring tool typically comprises a housing having an axially extending open end adapted for receiving the coaxial cable and a cutting tool mounted to the housing and extending coaxially toward the opening. The cutting tool typically includes an auger-like cylindrical coring portion having an outside diameter sized to be received within the outer conductor of the coaxial cable, an axially extending bore for receiving the inner conductor of the coaxial cable, and at least one cutting edge at the end of the coring portion which removes a portion of the dielectric material as the coring tool enters the end of the cable. In addition to using standard commercially available coring tools, excellent results can be observed by using coring tools in which the cutting edges have been specially configured to promote tearing, rather than slicing, of the dielectric and precoat layer.

The controlled bond adhesion force properties achieved pursuant to the present invention can be measured by subjecting coaxial cable test specimens to standard test methods. For example, the axial and rotational shear adhesion force of the precoat bond interfaces, i.e. the "A" bond interface and the "B" bond interface, are measured using a modified test procedure based upon ANSI/SCTE test method 12 2001 as follows:

TEST FOR DETERMINING THE SHEAR FORCE NEEDED TO DISRUPT THE ADHESIVE BOND BETWEEN PRECOAT AND CENTER CONDUCTOR OF TRUNK AND DISTRIBUTION COAXIAL CABLES 1.0 Scope 1.1 This test is used to determine the shear force needed to disrupt the adhesive bond between a coaxial cable center conductor and the dielectric or precoat layer for Trunk and Distribution cables with solid tubular outer conductors. The shear force of bond disruption is determined in both axial (translational) and rotational modes.

2.0 Equipment 2.1 Tubing cutter.

2.2 Utility knife or other sharp knife.

2.3 Saw capable of cutting through outer conductor in the linear direction without damage to the center conductor (Dremel tool, etc.).

2.4 Ruler marked in at least 1/32"" gradations.

2.5 Tensile tester (Instron 446X series or Sintech 5X or equivalent).

Figure 3:
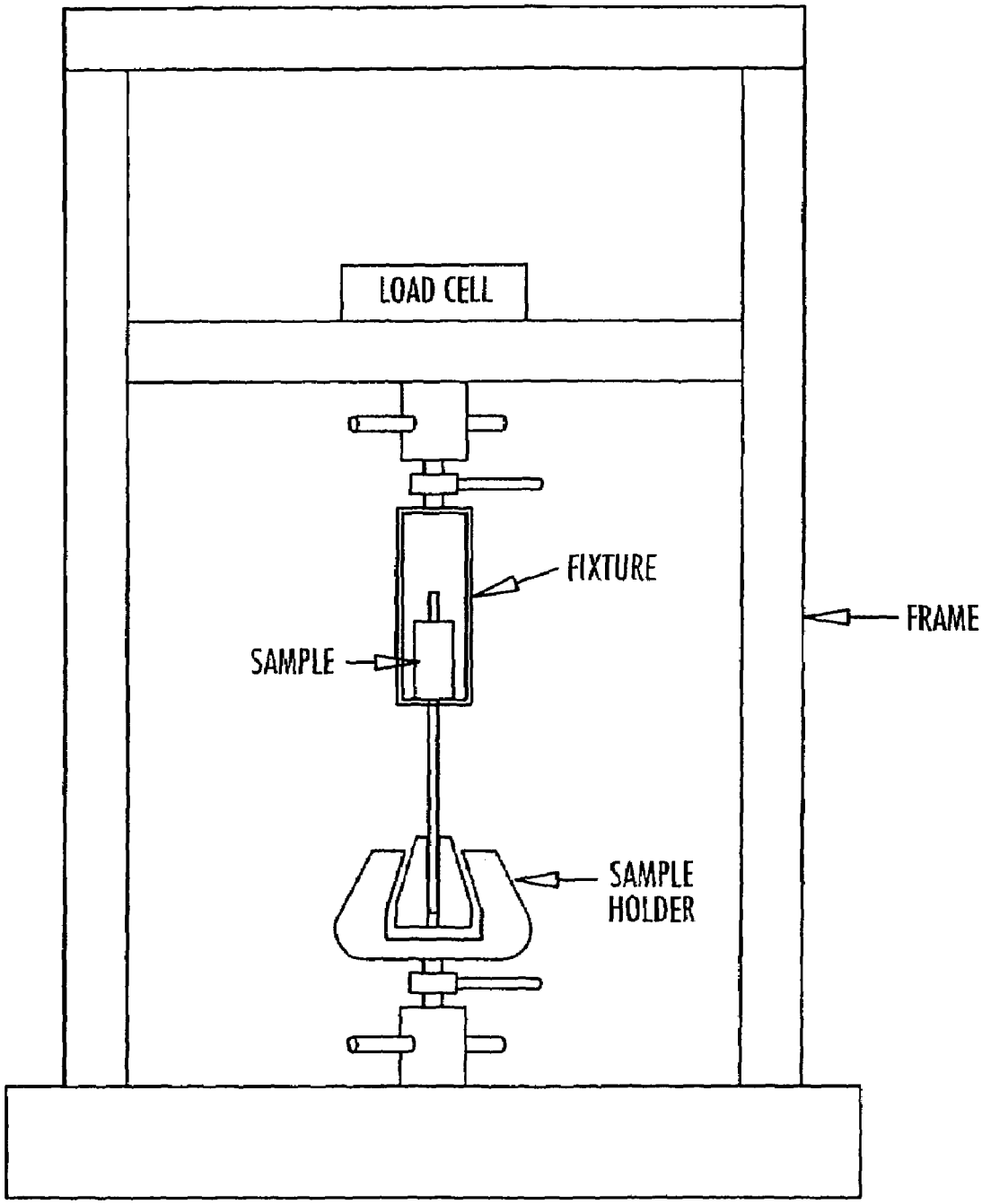
FIG. 3 is schematic illustration of a tensile test apparatus useful for testing the axial shear force needed to disrupt the adhesive bond between the precoat and the center conductor.

2.6 Center conductor/precoat bond pull out fixture as illustrated in FIG. 3 and described in ANSI/SCTE 12 2001.

Figure 4:
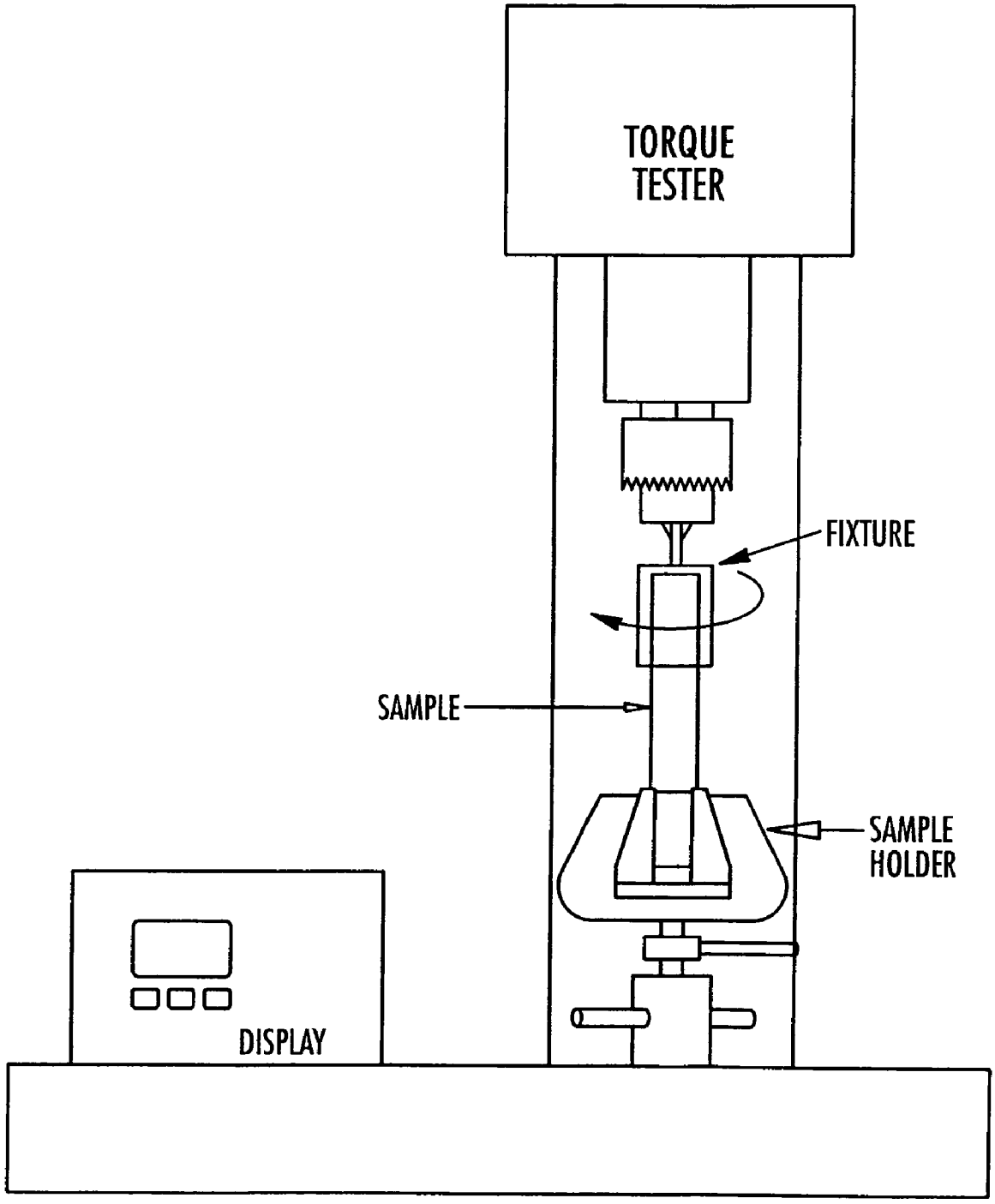
FIG. 4 is schematic illustration of a tensile test apparatus useful for testing the rotational shear force needed to disrupt the adhesive bond between the precoat and the center conductor.

2.7 Center conductor/precoat rotational bond tester fixture as illustrated in FIG. 4. Instruments such as Pharmatron TM-200 and Vibrac Torqo 1502 or their functional equivalent are acceptable.

3.0 Sample Preparation 3.1 Obtain cable samples of 10-12 inches in length.

3.2 Remove outer jacket if present.

3.3 Measuring from one end, mark the sample on the outer conductor at 1 and 2 inches.

3.4 Using the tubing cutter, cut through the outer shield to a depth of no more than 1/16 inch at each mark.

3.5 Cut through the remaining dielectric at the above cuts taking care not to score or damage the center conductor.

3.6 Cut through the outer conductor along the axis of the center conductor on the entire sample length except for the section between 1 and 2 inches. Remove the outer conductor and dielectric from either side of the 1 inch long test sample without disturbing or damaging the test sample or center conductor.

4.0 Test Method 4.1 Axial test 4.1.1 Attach the center conductor bond pull out fixture to the tensile tester.

4.1.2 Select a center conductor insert 3.0±1.0 mils larger than the center conductor diameter and slide it onto the long stripped portion of the test sample, larger OD end first.

4.1.3 Place sample and insert into the test fixture and fasten the long end of the center conductor to the tensile tester.

4.1.4 Set the tensile tester to run at a rate of 2.0 inches/minute and begin the test.

4.1.5 Continue the test until the bond to the center conductor has been broken and record the maximum load (in pounds) observed during the test.

4.1.6 Repeat the test for a minimum of six specimens.

4.2 Rotational test 4.2.1 Insert the sample into the rotational bond tester using the appropriate fixtures.

4.2.2 Set the tester to rotate at a rate of 1 rpm and begin the test.

4.2.3 Continue the test until the dielectric/precoat breaks free from the center conductor or the center conductor fails.

4.2.4 Record the maximum torque in inch-pounds observed during the test and note whether the bond or center conductor failed.

4.2.5 Repeat the test for a minimum of six specimens.

5.0 Data analysis 5.1 Calculate and report the average load and standard deviation for each sample and report these results along with the sample name, description, outer conductor and center conductor dimensions and any other special notes deemed pertinent.

The axial shear strength of the bond interface between the precoat layer and the center conductor, i.e. the "A" bond, and the strength of the bond interface between the precoat layer and the dielectric layer, i.e. the "B" bond, are measured according to a modified ANSI/SCTE test method 12 2001 (formerly IPS-TP-102), "Test method for Center Conductor Bond to Dielectric for Trunk, Feeder, and Distribution Coaxial Cables, with the following modification. The fixture has a hole for center conductor insertion that is a minimum of 25% larger than the outer diameter of the combined center conductor and precoat layer. If the precoat layer strips cleanly from the center conductor without leaving portions thereof adhered to the center conductor, then it can be concluded that the ratio of the axial shear strength of the first bond interface ("A") bond to the axial shear strength of the second bond interface ("B") is less than 1. If the precoat layer remains adhered to the center conductor, then it can be concluded that the shear strength ratio is greater than 1. Likewise, if dielectric material remains adhered to the precoat layer, it can be concluded that the shear strength ratio is greater than 1, and that failure occurred in the dielectric and not at the precoat bond interface.

The rotational shear strength of the bond interface between the precoat layer and the center conductor, i.e. the "A" bond, and the rotational shear strength of the bond interface between the precoat layer and the dielectric layer, i.e. the "B" bond, are measured using the rotational test procedure described above. The ratio of the rotational shear strength of the "A" bond interface to that of the "B" bond interface should also be less than 1 if the precoat layer is to strip cleanly from the conductor under the rotational (or tangential) shear forces exerted by the coring tool. This is verified by examining the condition of the test specimen after performing the test. If the precoat layer strips cleanly from the center conductor without leaving portions thereof adhered to the center conductor, then it can be concluded that the ratio of the axial shear strength of the first bond interface ("A") bond to the axial shear strength of the second bond interface ("B") is less than 1. If the precoat layer remains adhered to the center conductor, then it can be concluded that the shear strength ratio is greater than 1. If dielectric material remains adhered to the precoat layer, it can be concluded that the shear strength ratio is greater than 1, and that failure occurred in the dielectric and not at the precoat bond interface.

It is also preferred that the bond adhesion forces be controlled so that when failure occurs at the center conductor-precoat bond interface, i.e. the "A" bond, the axial shear adhesion force is greater than the rotational shear adhesion force. The ratio of the axial shear adhesion force of the "A" bond to the rotational shear adhesion force of the "A" bond is determined by dividing mean value for the axial shear adhesion force (in pounds) by the mean value of the rotational shear adhesion torque force (in inch-pounds). Preferably, the ratio of the axial shear adhesion force of the "A" bond formed by the precoat layer between the inner conductor to the dielectric layer to the rotational shear adhesion force of the "A" bond is 5 or greater, and more desirably 7 or greater. These values can be measured using the test procedure described above for samples in which failure occurs at the "A" bond interface, that is, samples with the requisite ratio of "A" bond strength to "B" bond strength of less than 1.

The present invention will now be further described by the following non-limiting example. All percentages are on a per weight basis unless otherwise indicated.

EXAMPLE

A precoat composition was formulated by compounding the following constituents:

97.5% of a 80 MI low density polyethylene 2.5% of a 5.5 MI ethylene acrylic acid copolymer (6.5% acrylic acid content)

This composition was applied to copper-clad aluminum conductors of a diameter ranging from 0.1085 to 0.2025 inch in accordance with the following procedures and conditions: The center conductor was preheated to 125° F. The composition was applied in a controlled thickness using a polymer extrusion process. The thickness of the application was controlled to a nominal average thickness of 0.008 inches. This structure allowed to cool to near ambient temperature and was then passed through a foaming polymer extrusion process to apply a closed cell foam polyethylene dielectric layer.

The specimens were tested by the test procedures described above to determine the shear force needed to disrupt the bond in both the axial and rotational modes, and the results are given in the following table.

| Sample | CC Diameter (in) | Rotational Bond (in. lb) | Axial Bond (lb) | Bond Ratio |
|---|---|---|---|---|
| 1 | 0.1085 | 9 | 147 | 16 |
| 2 | 0.1235 | 12 | 184 | 15 |
| 3 | 0.1365 | 16 | 206 | 13 |
| 4 | 0.1655 | 19 | 249 | 13 |
| 5 | 0.1665 | 19 | 251 | 13 |
| 6 | 0.1935 | 29 | 284 | 10 |
| 7 | 0.2025 | 30 | 252 | 8 |

Many modifications and other embodiments of the inventions set forth herein will come in mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed is:

1. A method of manufacturing a coaxial cable comprising:

directing a conductor along a predetermined path of travel into and through a preheater and preheating the conductor;

melting in a first extruder a thermoplastic polymer precoat composition;

directing the preheated conductor into and through the first extruder and extruding onto the surface of the center conductor a continuous thin coating layer of the molten precoat composition;

allowing the layer of precoat composition to cool and solidify forming a first bond interface ("A" bond) with the inner conductor;

maintaining the temperature of the conductor and layer of precoat composition no more than 200° F.;

directing the conductor and layer of precoat composition into and through a second extruder and extruding onto the coated conductor a foamable polymer composition, allowing the foamable polymer composition to expand, cool and solidify to form a foam dielectric surrounding the conductor with a second bond interface ("B" bond) between the layer of precoat composition and the dielectric;

surrounding the foam dielectric with a continuous metallic sheath forming the outer conductor of the coaxial cable; and controlling the bond adhesion forces at the first and second bond interfaces so that the ratio of the axial shear strength of the first ("A") bond to the axial shear strength of the second ("B") bond is less than 1.

2. The method of claim 1, wherein the polymer precoat composition comprises a homopolymer or copolymer composition selected from the group consisting of polyethylene homopolymer, amorphous and atactic polypropylene homopolymer, polyolefin copolymer, styrene copolymer, polyvinyl acetate, polyvinyl alcohol, paraffin waxes, and blends of two or more of the foregoing, and wherein the preheating step heats the conductor to a surface temperature of 100° F. to 300° F.

3. The method of claim 1, wherein the first extruder forms a precoat layer with a thickness of from 0.0001 to 0.020 inch.

4. A method of manufacturing a coaxial cable comprising:

directing a conductor along a predetermined path of travel into and through a preheater and preheating the conductor to a surface temperature of 75 ° F. to 300° F.;

melting in a first extruder a thermoplastic polymer precoat composition comprising a blend of low density polyethylene having a melt index of at least 50 g/10 min and ethylene acrylic acid copolymer;

directing the preheated conductor into and through the first extruder and extruding onto the surface of the center conductor a continuous coating layer of the molten precoat composition with a thickness of from 0.0001 to 0.020 inch;

allowing the layer of precoat composition to cool and solidify forming a first bond interface ("A" bond) with the inner conductor;

directing the conductor and layer of precoat composition into and through a second extruder and extruding onto the coated conductor a foamable polyolefin polymer composition;

allowing the foamable polymer composition to expand, cool and solidify to form a closed cell polyolefin foam dielectric surrounding the conductor with a second bond interface ("B" bond) between the layer of precoat composition and the dielectric;

surrounding the foam dielectric with a continuous metallic sheath forming the outer conductor of the coaxial cable; and controlling the bond adhesion forces at the first and second bond interfaces so that the ratio of the axial shear strength of the first ("A") bond to the axial shear strength of the second ("B") bond is less than 1.

5. The method of claim 4, including also controlling the bond adhesion forces so that the ratio of the rotational shear strength of the first ("A") bond to the rotational shear strength of the second ("B") bond is less than 1.

6. The method cable of claim 4, including also controlling the bond adhesion forces so that the ratio of the axial shear adhesion force of the "A" bond to the rotational shear adhesion force of the "A" bond is 5 or greater.

* * * * *